US008257117B2

(12) United States Patent
Pepe et al.

(10) Patent No.: US 8,257,117 B2
(45) Date of Patent: Sep. 4, 2012

(54) ELECTRICAL CONNECTOR HAVING A FIRST GROUP OF TERMINALS TALLER THAN THAT OF A SECOND GROUP OR LOCATED IN A NON-PARALLEL PLANE

(75) Inventors: Paul John Pepe, Clemmons, NC (US); Ralph Sykes Martin, Mount Airy, NC (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 13/010,464

(22) Filed: Jan. 20, 2011

(65) Prior Publication Data

US 2012/0190245 A1 Jul. 26, 2012

(51) Int. Cl.
*H01R 24/00* (2006.01)
*H01R 4/24* (2006.01)

(52) U.S. Cl. ..... 439/676; 439/404

(58) Field of Classification Search ..... 439/676–679, 439/404, 620.22, 660
See application file for complete search history.

(56) References Cited

U.S. PATENT DOCUMENTS 5,905,637 A 5/1999 Su
5,967,801 A 10/1999 Martin et al.
5,971,792 A 10/1999 Lin
6,010,353 A 1/2000 Ensz et al.
6,062,895 A 5/2000 Lin et al.
6,116,943 A 9/2000 Ferrill et al.
6,193,526 B1 2/2001 Milner et al.
6,283,768 B1 9/2001 Van Naarden
6,371,793 B1 4/2002 Doorhy et al.
6,394,835 B1 5/2002 Milner et al.
6,447,326 B1 9/2002 Teach et al.
6,682,363 B1 1/2004 Chang
RE38,519 E 5/2004 Doorhy et al.
6,799,989 B2 * 10/2004 Doorhy et al. ..... 439/404
7,114,985 B2 10/2006 Doorhy et al.
7,331,830 B2 * 2/2008 Minich ..... 439/857
7,364,470 B2 * 4/2008 Hashim ..... 439/676
8,002,571 B2 * 8/2011 Hogue et al. ..... 439/404
2009/0209139 A1 * 8/2009 Ho ..... 439/676
2010/0317230 A1 * 12/2010 Larsen et al. ..... 439/620.22

* cited by examiner

*Primary Examiner* — Chandrika Prasad

(57) ABSTRACT

An electrical connector is provided. The connector includes a substrate having a wire end and a mating end. The substrate has signal traces extending between the wire end and the mating end. Wire terminals are joined to the wire end of the substrate. Each of the wire terminals is electrically coupled to a signal trace. Each of the wire terminals is configured to couple to a conductor of a cable. Mating contacts are joined to the mating end of the substrate. Each of the mating contacts is electrically coupled to a signal trace so that the signal trace directs electrical signals between a wire terminal and the mating contact. The mating contacts are configured to engage a contact of a corresponding connector.

20 Claims, 8 Drawing Sheets

ELECTRICAL CONNECTOR HAVING A FIRST GROUP OF TERMINALS TALLER THAN THAT OF A SECOND GROUP OR LOCATED IN A NON-PARALLEL PLANE

FIELD OF THE INVENTION

The subject matter described herein relates to an electrical connector and, more particularly, to an electrical connector having a substrate.

BACKGROUND OF THE INVENTION

Electrical connectors are commonly used to couple a cable to a corresponding jack, cable, electrical device or the like. The electrical connector includes wire terminals positioned at a wire end of the connector. The wire terminals are configured to terminate twisted pairs of the cable and are generally housed in a load bar that is positioned within the connector. Specifically, each wire of a twisted pair is separated and joined to a terminal in the load bar. Contacts are coupled to the load bar at a mating end of the connector. The load bar carries electrical signals, for example, power and/or data signals, from the cable to the contacts. The contacts are configured to mate with corresponding contacts of the jack, cable, electrical device or the like. Accordingly, the connector carries the electrical signals from the cable to the corresponding jack, cable, electrical device or the like.

However, conventional electrical connectors are not without their disadvantages. In some electrical connectors wire terminals are positioned in close proximity to one another. Accordingly, electromagnetic crosstalk may be experienced between the wire terminals. Specifically, the wire terminals may experience crosstalk between differential pairs of the cable. Excessive crosstalk may impair the performance of the connector. For example, the crosstalk may reduce a speed at which the connector is capable of carrying the electrical signals. The crosstalk may also interfere with the electrical signals, thereby rendering the connector inoperable.

Additionally, conventional connectors typically include limited space for coupling wires thereto. For example, each wire of a cable must be joined to the connector within the confines of the load bar. The load bar may not be capable of accommodating all sizes of wire. As such, the connector is limited to use with cables having wire that is capable of joining to the load bar.

A need remains for an electrical connector that controls crosstalk between the differential pairs of a cable. Another need remains for an electrical connector that is capable of accommodating different size wires.

SUMMARY OF THE INVENTION

In one embodiment, an electrical connector is provided. The connector includes a substrate having a wire end and a mating end. The substrate has signal traces extending between the wire end and the mating end. Wire terminals are joined to the wire end of the substrate. Each of the wire terminals is electrically coupled to a signal trace. Each of the wire terminals is configured to couple to a conductor of a cable. The wire terminals are arranged in a front group and a rear group. The front group of wire terminals is positioned proximate to the wire end of the substrate. The rear group of wire terminals is positioned distally from the wire end of the substrate. The front group of wire terminals has a height that is different than a height of the rear group of wire terminals. Mating contacts are joined to the mating end of the substrate.

Each of the mating contacts is electrically coupled to a signal trace such that the signal trace directs electrical signals between a wire terminal and the mating contact. The mating contacts are configured to engage a contact of a corresponding connector.

In another embodiment, an electrical connector is provided. The connector includes a housing having a wire end and a mating end. A substrate is positioned within the housing. The substrate has a wire end proximate to the wire end of the housing and a mating end proximate to the mating end of the housing. The substrate has signal traces extending between the wire end and the mating end. Wire terminals are joined to the wire end of the substrate. Each of the wire terminals is electrically coupled to a signal trace. Each of the wire terminals is configured to couple to a conductor of a cable. The wire terminals are arranged in a front group and a rear group. The front group of wire terminals is positioned proximate to the wire end of the substrate. The rear group of wire terminals is positioned distally from the wire end of the substrate. The front group of wire terminals has a height that is different than a height of the rear group of wire terminals. Mating contacts are joined to the mating end of the substrate. Each of the mating contacts is electrically coupled to a signal trace such that the signal trace directs electrical signals between a wire terminal and the mating contact. The mating contacts are configured to engage a contact of a corresponding connector.

In another embodiment, an electrical connector is provided. The connector includes a substrate having a wire end and a mating end. The substrate has signal traces extending between the wire end and the mating end. A front group of wire terminals is joined to the substrate proximate to the wire end of the substrate. The wire terminals of the front group are configured as blades that extend in a plane that is non-orthogonal to the wire end of the substrate. A rear group of wire terminals is joined to the substrate distally from the wire end of the substrate. The wire terminals of the rear group are configured as blades that extend in a plane that is non-parallel to the plane of the front group of wire terminals. Mating contacts are joined to the mating end of the substrate. The mating contacts including front mating contacts and rear mating contacts. The front group of wire terminals is electrically coupled to the front mating contacts and the rear group of wire terminals is electrically coupled to the rear mating contacts.

DETAILED DESCRIPTION OF THE DRAWINGS

The foregoing summary, as well as the following detailed description of certain embodiments will be better understood when read in conjunction with the appended drawings. As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Figure 1:
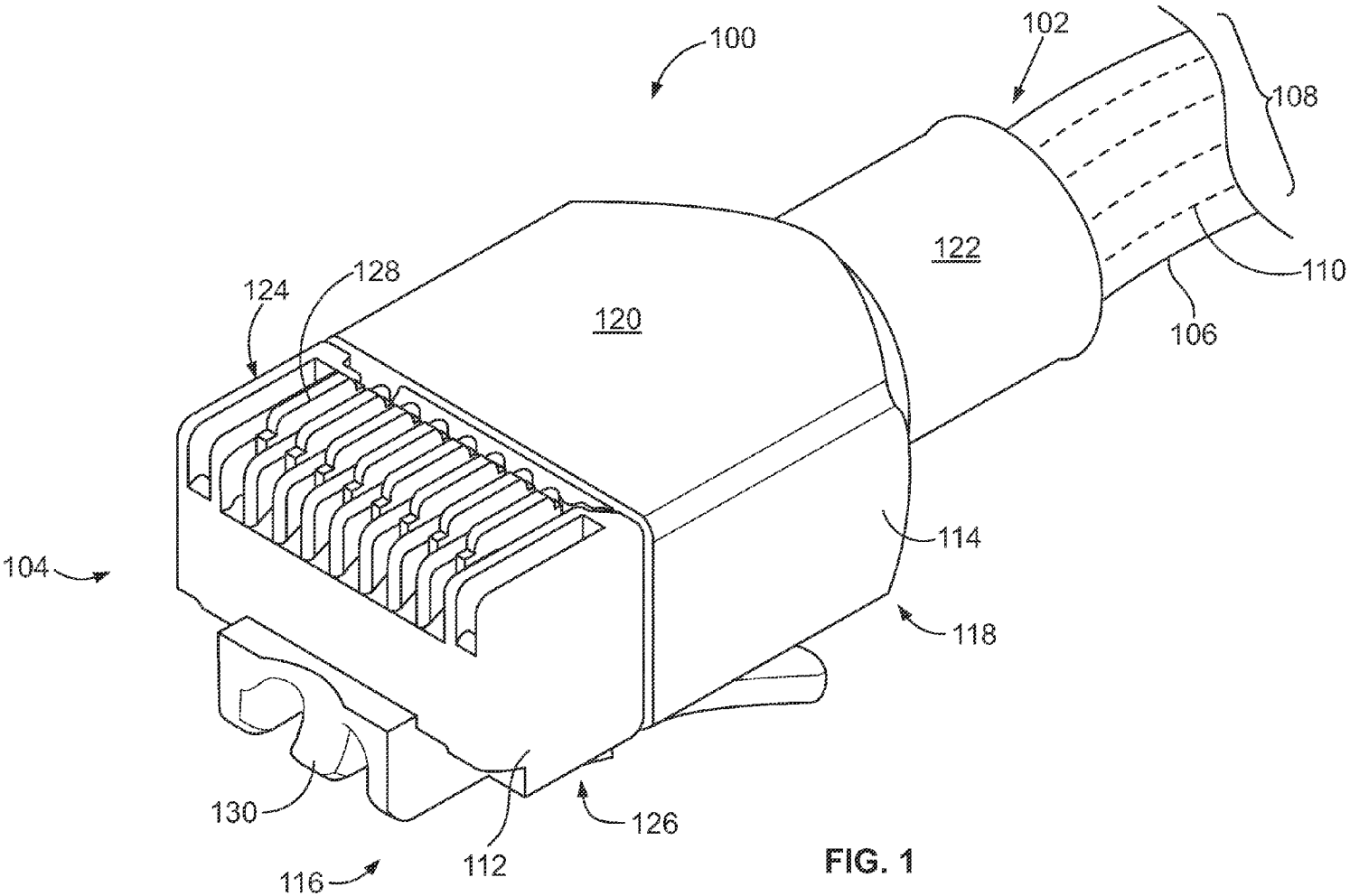
FIG. 1 is a top perspective view of an electrical connector formed in accordance with an embodiment.

FIG. 1 illustrates an electrical connector 100 formed in accordance with an embodiment. In an exemplary embodiment, the electrical connector is a RJ-45 plug. However, the embodiments described herein may be used with any suitable connector, receptacle or plug. The electrical connector 100 includes a wire end 102 and a mating end 104. The wire end 102 is configured to be joined to a cable 106. The cable 106 is inserted into the wire end 102 of the connector 100 in a loading direction 107. The cable 106 includes a conductor 108 having wires 110 arranged in twisted pairs. In one embodiment, the wires 110 are arranged in differential pairs which enable signal transmission via signals on separate wires that are approximately 180 degrees out of phase with each other. The wires 110 of the cable 106 are configured to be electrically coupled to the connector 100. The mating end 104 of the connector 100 is configured to join a corresponding connector (not shown).

The connector 100 includes a housing 112 and a shield 114. The housing 112 may have a size similar to that of a Cat.-6 housing. Cat.-6 cable is the standard for Gigabit Ethernet and other network protocols that are backward compatible with the Category 5/5e and Category 3 cable standards. Cat.-6 features more stringent specifications for crosstalk and system noise. The Cat.-6 cable standard provides performance of up to 250 MHz and is suitable for 10BASE-T, 100BASE-TX (Fast Ethernet), 1000BASE-T/1000BASE-TX (Gigabit Ethernet) and 10GBASE-T (10-Gigabit Ethernet). Cat.-6 cable has a reduced maximum length when used for 10GBASE-T, is characterized to 500 MHz and has improved alien crosstalk characteristics, allowing 10 GBASE-T to be run for the same distance as previous protocols.

In an exemplary embodiment, the housing 112 is formed from polycarbonate. Alternatively, the housing 112 may be formed from any suitable non-conductive material. The housing 112 has a mating end 116 and a wire end 118. The shield 114 is joined to the wire end 118 of the housing 112. The shield 114 includes a housing portion 120 and a cable portion 122. The housing portion 120 is joined to the wire end 118 of the housing 112. The cable portion 122 extends from the housing portion 120. The cable portion 122 is joined to the cable 106. The shield 114 protects the connector 100 from electro-magnetic interference.

The housing 112 includes a top 124 and a bottom 126. The top 124 of the housing 112 includes a plurality of mating contacts 128. The mating contacts 128 are configured to electrically couple to contacts positioned on the corresponding connector. The mating contacts 128 create an electrical connection between the connector 100 and the corresponding connector. The mating contacts 128 may be formed from phos-bronze. The mating contacts 128 may include a gold plated surface. Alternatively, the mating contacts 128 may be formed from any suitable conductive material and/or have any suitable conductive plating.

The bottom 126 of the connector 100 includes a latch 130. The latch 130 is configured to engage a corresponding mechanism on the corresponding connector. The latch 130 secures the connector 100 to the corresponding connector. In an alternative embodiment, the connector 100 and the corresponding connector may include any suitable corresponding engagement mechanisms to join the connector 100 to the corresponding connector.

Figure 2:
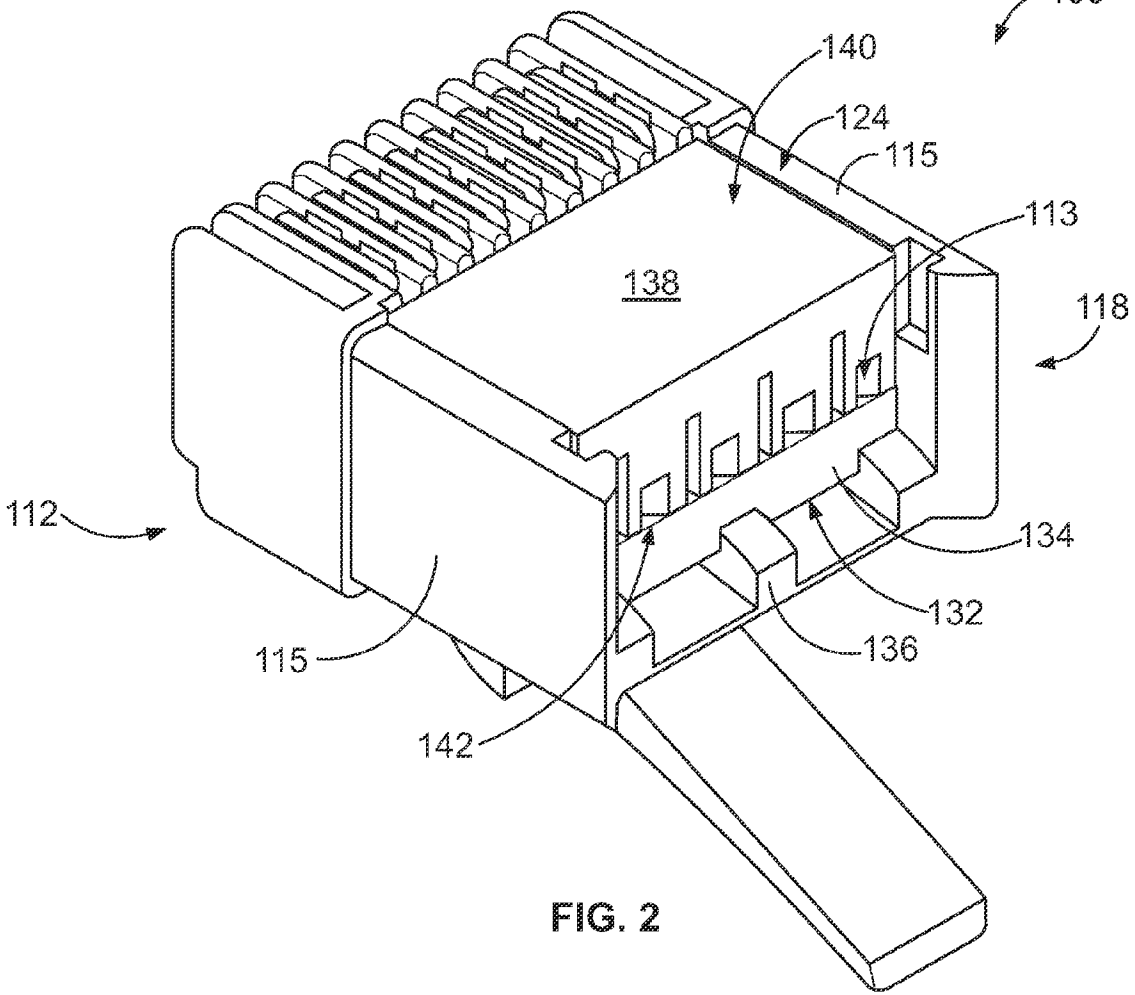
FIG. 2 is a top perspective view of the electrical connector shown in FIG. 1 and having the shield removed.

FIG. 2 illustrates the electrical connector 100 with the shield 114 removed. The wire end 118 of the housing 112 includes a cavity 113 defined by sidewalls 115 of the housing 112. An electrical assembly 132 is positioned within the cavity 113. The electrical assembly 132 includes a substrate 134 that extends between the sidewalls 115 of the housing 112. The substrate 134 may be a circuit board, for example, a printed circuit board. The substrate 134 is retained within the housing 112 by tabs 136 positioned on the wire end 118 of the housing 112.

A retention housing 138 is positioned over the substrate 134. The retention housing 138 extends between the sidewalls 115 of the housing 112. The retention housing 138 includes a top 140 and a bottom 142. The bottom 142 of the retention housing 138 rests on the substrate 134. The retention housing 138 extends from the substrate 134 to the top 124 of the housing 112. The top 140 of the retention housing 138 is substantially flush with the top 124 of the housing 112. Alternatively, the top 140 of the retention housing 138 may be recessed with respect to the top 124 of the housing 112 or extend beyond the top 124 of the housing 112. The retention housing 138 is configured to retain the electrical assembly 132 within the housing 112.

Figure 3:
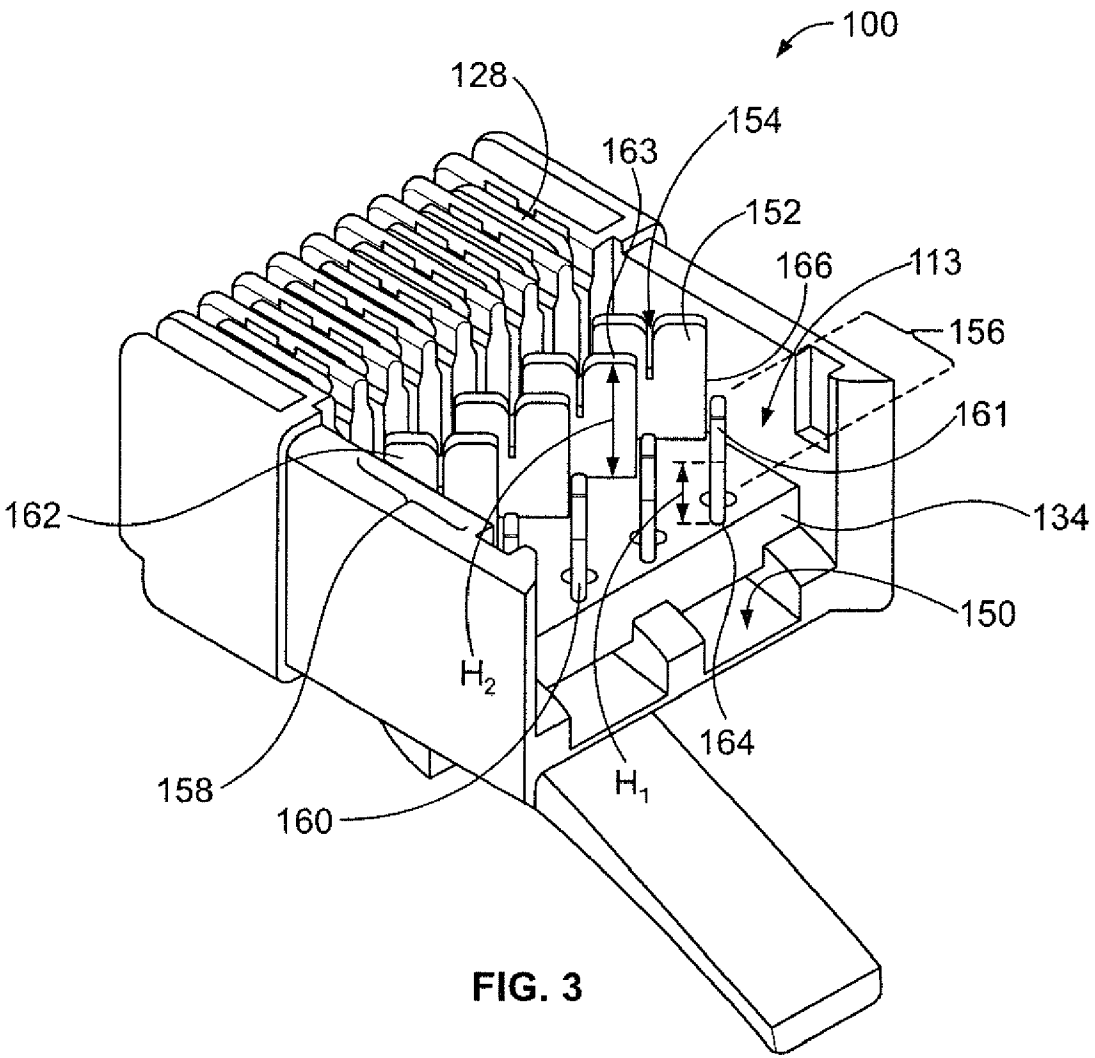
FIG. 3 is a top perspective view of the electrical connector shown in FIG. 2 and having the retention housing removed.

FIG. 3 illustrates the electrical connector 100 with the retention housing 138 removed. The substrate 134 rests on a bottom 150 of the cavity 113. The substrate 134 includes a wire end 135 and a mating end 137. The substrate 134 includes wire terminals 152 joined thereto. In one embodiment, the wire terminals 152 are joined to apertures in the substrate 134 through an interference fit. Optionally, the wire terminals 152 may be surface mounted to the substrate 134 through soldering, welding, adhesion, or the like. The wire terminals 152 may be formed from phos-bronze and include a matte-tin over nickel plating. Alternatively, the wire terminals 152 may be formed from any conductive material. The wire terminals 152 are configured as blades having a slot 154 that is configured to receive a wire 110 of the cable 106. The slot 154 is configured to receive stranded and/or solid wires 110. The wires 110 are retained within the slot 154 through an interference fit. Optionally, the wires 110 may be soldered, welded, and/or adhesively joined to the wire terminal 152. The substrate 134 electrically couples the wire terminals 152 to the mating contacts 128.

The wire terminals 152 are arranged in a front group 156 and a rear group 158. The terminals 152 of the front group 156 and the rear group 158 are arranged in rows. Optionally, the terminals 152 of the front group 156 and/or the rear group 158 may be offset from one another. The front group 156 is positioned closer to the wire end 118 of the housing 112 than the rear group 158. The front group 156 is positioned proximate to the wire end 135 of the substrate 134. The rear group 158 is positioned distally from the wire end 135 of the substrate and proximate to the mating end 137 of the substrate 134. The front group 156 includes front wire terminals 160 and the rear group 158 includes rear wire terminals 162. The front wire terminals 160 have a height $H_1$ and the rear wire terminals 162 have a height $H_2$. The height $H_1$ of the front wire terminals 160 is defined between the substrate 134 and a top 161 of the front wire terminals 160. The height $H_2$ of the rear wire terminals 162 is defined between the substrate 134 and a top 163 of the rear wire terminals 162. The height $H_1$ of the front wire terminals 160 is different than the height $H_2$ of the rear wire terminals 162. In one embodiment, the height $H_1$ of the front wire terminals 160 is less than the height $H_2$ of the rear wire terminals 162. Optionally, the height $H_1$ of the front wire terminals 160 may be greater than the height $H_2$ of the rear wire terminals 162. In the illustrated embodiment, the top 163 of the rear wire terminals 162 is offset from the top 161 of the front wire terminals 160. The top 163 of the rear wire terminals 162 is stepped up a distance ($H_2$–$H_1$) from the top 161 of the front wire terminals 160.

The front wire terminals 160 are configured to receive the first wires of differential pairs of wires 110. The rear wire terminals 162 are configured to receive the second wires of the differential pairs of wires 110. The differential pairs of wires 110 of the cable 106 are separated between the front wire terminals 160 and the rear wire terminals 162. The front wire terminals 160 and the rear wire terminals 162 are arranged at different heights to control crosstalk between the differential pairs. The arrangement of the front wire terminals 160 with respect to the rear wire terminals 162 limits crosstalk between the differential pairs to a predetermined level.

The wire terminals 152 may be configured to accommodate either stranded or solid wires 110. In one exemplary embodiment, the wire terminals 152 accommodate wires 110 having different sizes. In another embodiment, the wire terminals 152 may be removable from the substrate 134. The wire terminals 152 may be replaceable with other wire terminals 152 having different size slots 154. The wire terminals 152 may be replaced to accommodate cables 106 having different size wires 110.

Figure 4:
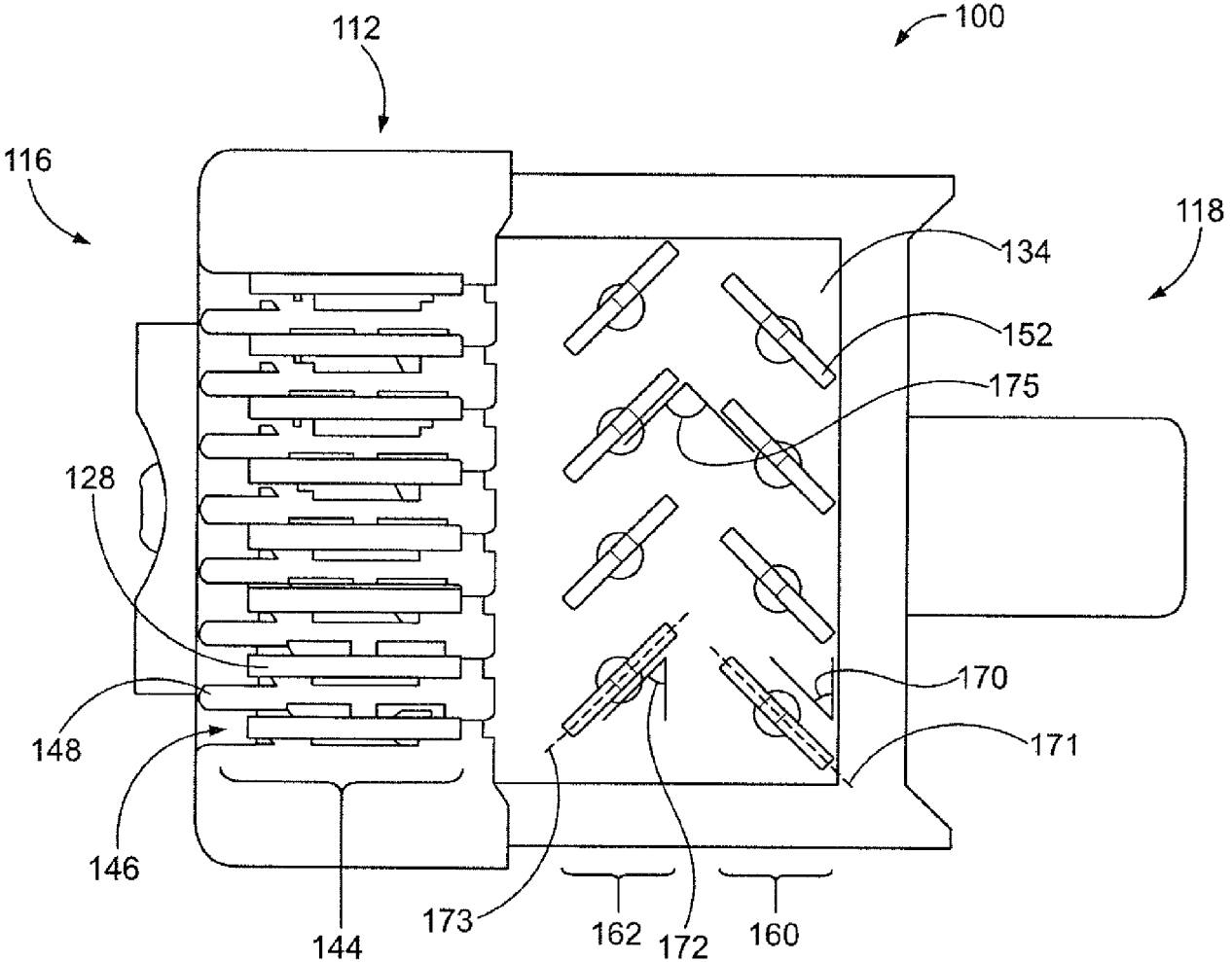
FIG. 4 is a top view of the electrical connector shown in FIG. 3.

FIG. 4 is a top view of the electrical connector 100. The mating end 116 of the housing 112 includes a contact holder 144. The contact holder 144 includes slots 146. The slots 146 are separated by partitions 148. The mating contacts 128 are positioned within the slots 146. The mating contacts 128 are arranged in parallel. Alternatively, the mating contacts 128 may be offset from one another and/or arranged at angles with respect to one another. The substrate 134 extends beneath the contact holder 144. The substrate 134 is accessible through the slots 146 of the contact holder 144. The mating contacts 128 are positioned within the slots 146 and mounted to the substrate 134. In one embodiment, the mating contacts 128 are joined to an opening in the substrate 134 through an interference fit. Optionally, the mating contacts 128 may be surface mounted to the substrate through soldering, welding, adhesion, or the like.

The wire terminals 152 are arranged at angles with respect to the wire end 118 of the housing 112 and the wire end 135 of the substrate 134. The front wire terminals 160 extend in a plane 171. The planes 171 of the front wire terminals 160 are arranged at an angle 170 with respect to the wire end 118 of the housing 112. In one embodiment the angle 170 is approximately 45 degrees. Optionally, the angle 170 may be any suitable angle. In one embodiment, each front wire terminal 160 is arranged at a different angle 170. The planes 171 of the front wire terminals 160 extend non-orthogonally to the wire end 135 of the substrate 134. The planes 171 of the front wire terminals 160 extend non-orthogonally to the loading direction 107 of the cable 106.

The rear wire terminals 162 extend in a plane 173. The planes 173 of the rear wire terminals 162 are arranged at an angle 172 with respect to the wire end 118 of the housing 112. In one embodiment the angle 172 is approximately 45 degrees. Optionally, the angle 172 may be any suitable angle. In one embodiment, each rear wire terminal 162 is arranged at a different angle 172. The planes 173 of the rear wire terminals 162 extend non-orthogonally to the wire end 135 of the substrate 134. The planes 173 of the rear wire terminals 162 extend non-orthogonally to the loading direction 107 of the cable 106.

The planes 171 of the front wire terminals 160 extend non-parallel to the planes 173 of the rear wire terminals 162. The angle 170 of the front wire terminals 160 is opposite the angle 172 of the rear wire terminals 162. The front wire terminals 160 are arranged at an angle 175 with respect to the rear wire terminals 162. In one embodiment, the angle 175 is approximately 90 degrees. Optionally, the front wire terminals 160 may be arranged at any angle 175 with respect to the rear wire terminals 162.

The front wire terminals 160 and the rear wire terminals 162 are arranged at the angles 170, 172 to control crosstalk between the differential pairs joined to the front wire terminals 160 and the rear wire terminals 162. In one embodiment, the angles 170, 172 reduce crosstalk between the differential pairs. In one embodiment, the angles 170, 172 limit crosstalk to a predetermined level.

Figure 5:
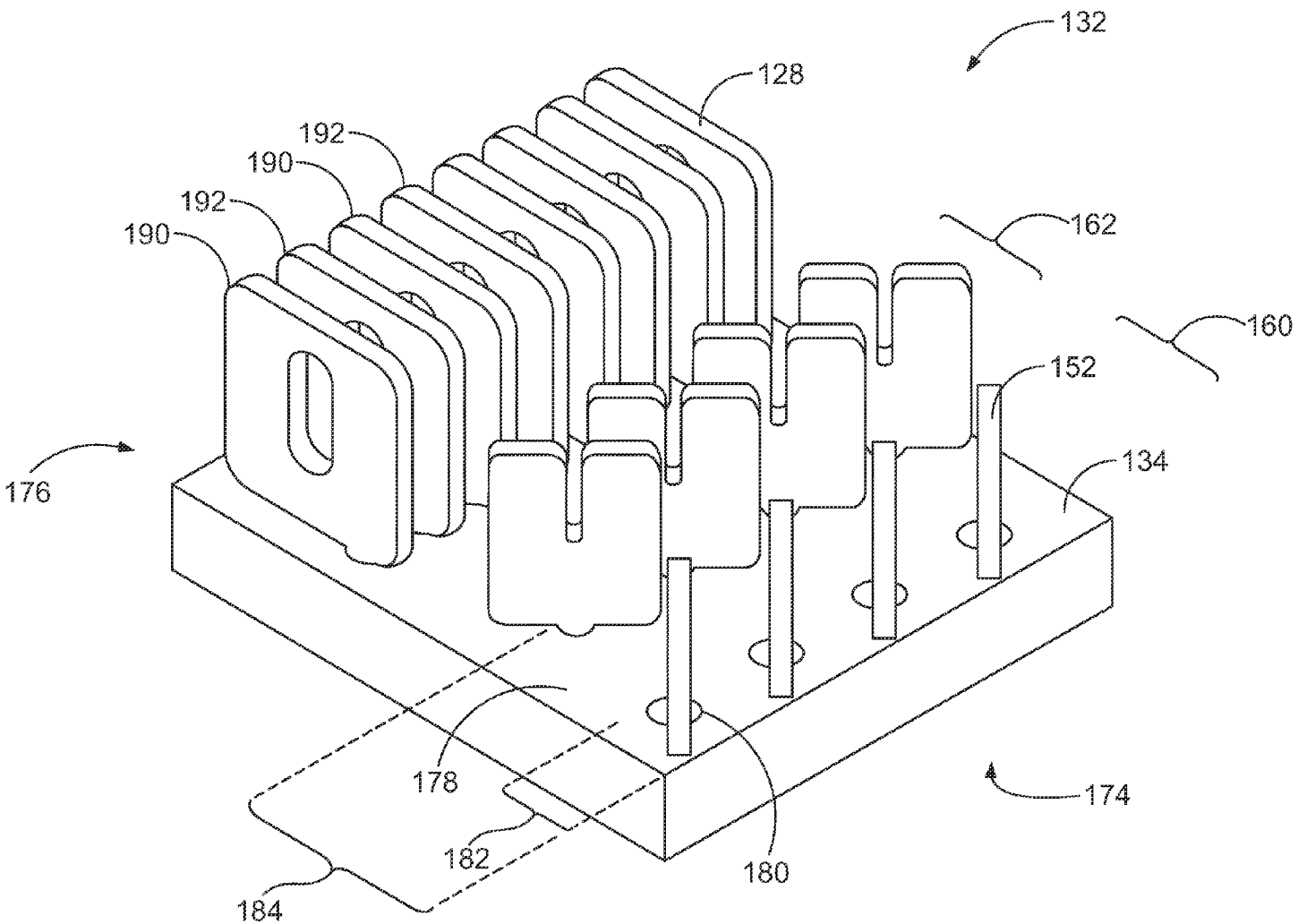
FIG. 5 is a top perspective view of an electrical assembly formed in accordance with an embodiment.

FIG. 5 is a top perspective view of the electrical assembly 132. The substrate 134 includes a wire end 174 and a mating end 176. The mating end 176 is configured to position proximate to the mating end 116 of the housing 112. The mating end 176 is configured to extend below the contact holder 144 of the housing 112. The wire end 174 is configured to position proximate to the wire end 118 of the housing 112. A mounting surface 178 extends between the mating end 176 and the wire end 174. Apertures 180 extend through the mounting surface 178. The apertures 180 are configured to receive a wire terminal 152 or a mating contact 128. The apertures 180 proximate to the mating end 176 are configured to receive mating contacts 128. The apertures 180 proximate to the wire end 174 are configured to receive wire terminals 152.

The wire terminals 152 are joined to the substrate 134 proximate to the wire end 174 of the substrate 134. The wire terminals 152 are through-hole mounted to the apertures 180. Optionally, the wire terminals 152 may be surface mounted to the substrate 134. For example, the wire terminals 152 may be soldered, welded, adhered, or otherwise joined to the substrate 134. The front wire terminals 160 are positioned closer to the wire end 174 of the substrate 134 than the rear wire terminals 162. The front wire terminals 160 are positioned a distance 182 from the wire end 174 of the substrate 134. The rear wire terminals 162 are positioned a distance 184 from the wire end 174 of the substrate 134 distance 184 is greater than the distance 182.

The mating contacts 128 are joined to the substrate 134 proximate to the mating end 176 of the substrate 134. The mating contacts 128 are through-hole mounted to the apertures 180 formed in the substrate 134. Optionally, the mating contacts 128 may be soldered, welded, adhered or otherwise joined to the substrate 134. The substrate 134 electrically couples the mating contacts 128 and the wire terminals 152. The mating contacts 128 are arranged in parallel. Optionally, the mating contacts 128 may be offset from one another.

The mating contacts 128 include front mating contacts 190 and rear mating contacts 192. The front mating contacts 190 are electrically joined to the front wire terminals 160. The rear mating contacts 192 are electrically joined to the rear wire terminals 162. The terms "front" and "rear" as used with respect to the mating contacts 128 designates the wire terminal 152 to which the mating contact 128 is joined. The terms "front" and "rear" as used with respect to the mating contacts 128 are not used to designate a position of the mating contacts 128. In the illustrated embodiment, the front mating contacts 190 and the rear mating contacts 192 alternate along the mounting surface 178. Alternatively, the front mating contacts 190 and the rear mating contacts 192 may be arranged in any configuration.

The substrate 134 channels electrical signals between the wire terminals 152 and the mating contacts 128. The electrical signals may be data and/or power signals. Electrical signals are directed between each front wire terminal 160 and a front mating contact 190. Electrical signals are directed between each rear wire terminal 162 and a rear mating contact 192. The substrate 134 includes circuitry that limits crosstalk between the electrical signals. The circuitry of the substrate may be tuned to achieve a predetermined speed of the electrical signals. The circuitry may be tuned to achieve a predetermined performance of the connector 100.

Figure 6:
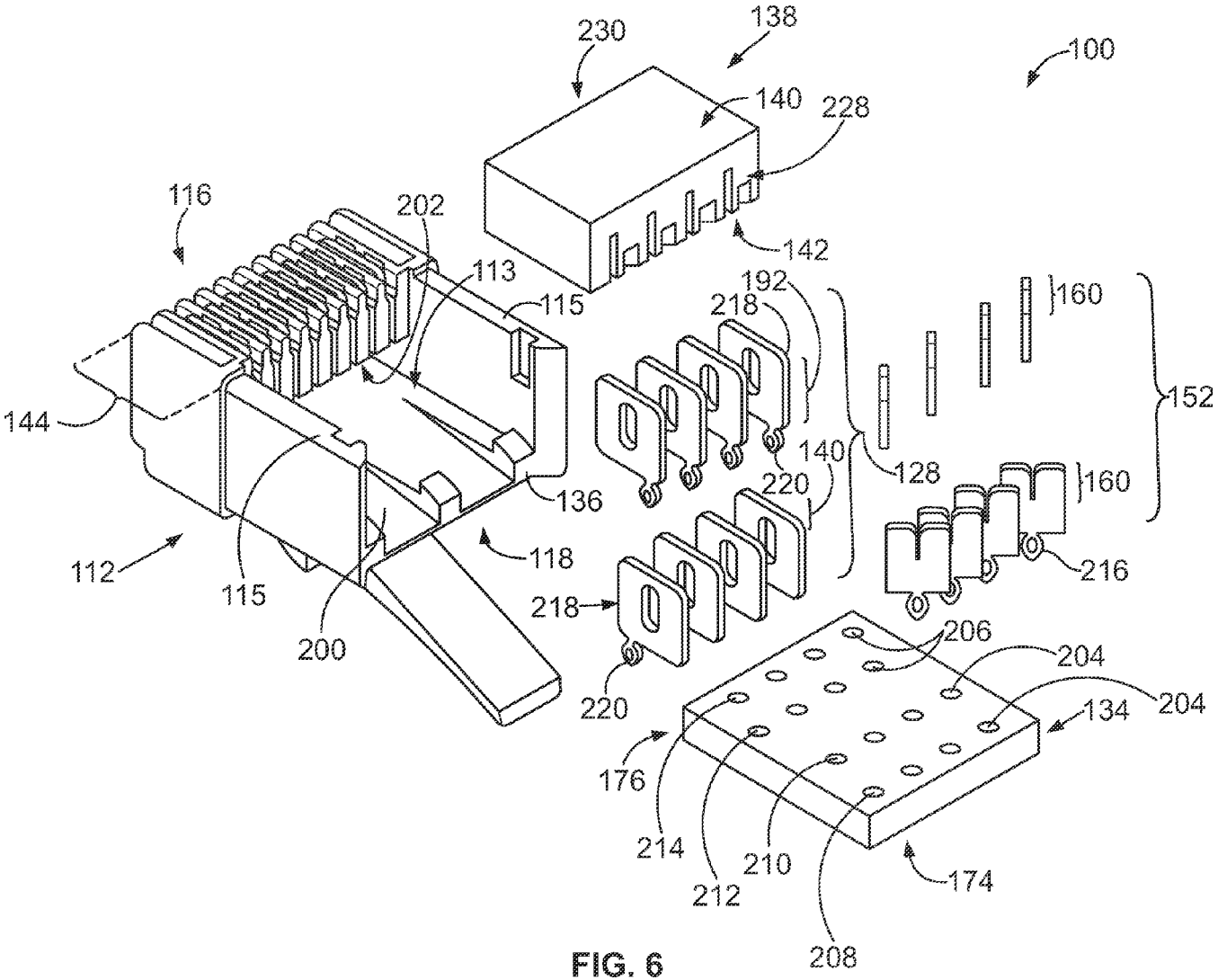
FIG. 6 is an exploded view of an electrical connector formed in accordance with an embodiment.

FIG. 6 illustrates an exploded view of an electrical connector 100. The housing 112 includes a substrate surface 200 formed on the inside of cavity 113. The substrate surface 200 extends between the wire end 118 and the mating end 116 of the housing 112. The substrate surface 200 extends underneath the contact holder 144. An opening 202 is located between the substrate surface 200 and the contact holder 144. The substrate 134 can be inserted into the housing 112 from the wire end 118 of the housing 112 so that the substrate 134 rests on the substrate surface 200. The mating end 176 of the substrate 134 is configured to be positioned within the opening 202 between the substrate surface 200 and the contact holder 144. The wire end 174 of the substrate 134 is configured to be positioned adjacent to the tabs 136 of the housing 112. The tabs 136 are configured to create an interference fit with the wire end 174 of the substrate 134 to retain the substrate 134 within the housing 112.

The substrate 134 includes terminal apertures 204 and contact apertures 206. The terminal apertures 204 are positioned proximate to the wire end 174 of the substrate 134. The terminal apertures 204 include front terminal apertures 208 and rear terminal apertures 210. The front terminal apertures 208 are positioned closer to the wire end 174 of the substrate than the rear terminal apertures 210. The contact apertures 206 are positioned proximate to the mating end 176 of the substrate 134. The contact apertures 206 include front contact apertures 212 and rear contact apertures 214. The rear contact apertures 214 are positioned closer to the mating end 176 of the substrate 134 than the front contact apertures 212.

The wire terminals 152 include a connector 216 extending therefrom. The connector 216 is formed as an eye-of-the-needle connector. The connectors 216 are configured to be inserted into the terminal apertures 204 of the substrate 134. The wire terminals 152 are retained within the substrate 134 through an interference fit between the connector 204 and an inner surface of the terminal apertures 204. The front wire terminals 160 are configured to be positioned within the front terminal apertures 208. The rear wire terminals 162 are configured to be positioned within the rear terminal apertures 210.

The mating contacts 128 include a connector end 218. A connector 220 extends from each mating contact 128 proximate to the connector end 218. The connector 220 is formed as an eye-of-the-needle connector. The connectors 220 are configured to be inserted into the contact apertures 206 of the substrate 134. The mating contacts 128 are retained within the substrate through an interference fit between the connector 220 and an inner surface of the contact aperture 206.

The front mating contacts 190 are configured to be inserted into the front contact apertures 212. The rear mating contacts 192 are configured to be inserted into the rear contact apertures 214. The front mating contacts 190 are aligned with the connector end 218 positioned distally from the mating end 176 of the substrate 134. The rear mating contacts 192 are aligned with the connector end positioned proximately to the mating end 176 of the substrate 134. The connector ends 218 of the front mating contacts 190 are configured to be positioned closer to the mating end 176 of the substrate 134 than the connector ends 218 of the rear mating contacts 192. Alternatively, the connector ends 218 of the rear mating contacts 192 may be configured to be positioned closer to the mating end 176 of the substrate 134 than the connector ends 218 of the front mating contacts 190. The position of the connector ends 218 of the mating contacts 128 is alternated to control crosstalk between the front mating contacts 190 and the rear mating contacts 192.

The retention housing 138 includes the top 140 and the opposite bottom 142. Sides 226 extend between the top 140 and the bottom 142. The retention housing 138 includes a front 228 and a rear 230 and is configured to be positioned within the cavity 113. The retention housing 138 rests on the substrate 134 such that the bottom 142 of the retention housing 138 abuts the mounting surface 178 of the substrate 134. The sides 226 of the retention housing 138 are configured to abut the side walls 115 of the housing 112. The retention housing 138 is held within the housing 112 with an interference fit between the sides 226 of the retention housing 138 and the side walls 115 of the housing 112. In one embodiment, the housing 112 and the retention housing 138 may include corresponding engagement features, for example, latches, notches and the like to retain the retention housing 138 within the housing 112. Optionally, the retention housing 138 and the substrate 134 may include corresponding engagement features to retain the retention housing 138 to the substrate 134. For example, the retention housing 138 may include pins that are received within apertures of the substrate 134.

The rear 230 of the retention housing 138 is configured to be positioned proximate to the mating end 116 of the housing 112. The rear 230 of the retention housing 138 abuts the contact holder 144. In one embodiment, the retention housing 138 and the contact holder 144 may include corresponding engagement mechanisms to couple the retention housing 138 to the contact holder 144. The front 228 is configured to be positioned proximate to the wire end 174 of the substrate 134. The retention housing 138 is configured to cover the terminal apertures 204 of the substrate 134.

Figure 7:
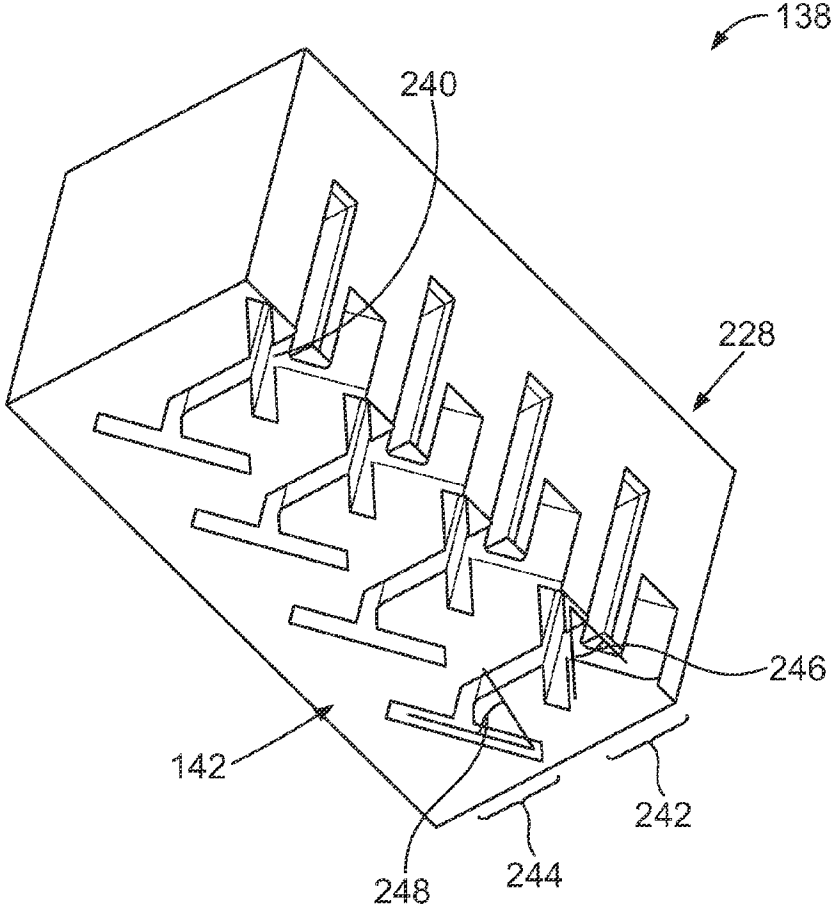
FIG. 7 is a bottom perspective view of a retention housing formed in accordance with an embodiment.

FIG. 7 illustrates the bottom 142 of the retention housing 138. The bottom 142 of the retention housing 138 has slots 240 extending therethrough. The slots 240 include front slots 242 and rear slots 244. The front slots 242 are positioned proximate to the front 228 of the retention housing 138. Each front slot 242 extends through the front 228 of the retention housing 138. The front slots 242 are configured to receive the front wire terminals 160 when the retention housing 138 is positioned within the housing 112. The front slots 242 are arranged at an angle 246 with respect to the front 228 of the retention housing 138. The angle 246 corresponds to the angle 170 of the front wire terminals 160. The front slots 242 retain the front wire terminals 160 in position when the retention housing 138 is joined to the housing 112.

The rear slots 244 are positioned between the front slots 242 and the rear 230 of the retention housing 138. The rear slots 244 are configured to receive the rear wire terminals 162 when the retention housing 138 is positioned within the housing 112. The rear slots 244 are arranged at an angle 248 with respect to the front 228 of the retention housing 138. The angle 248 corresponds to the angle 172 of the rear wire terminals 162. The rear slots 244 retain the rear wire terminals 162 in position when the retention housing 138 is joined to the housing 112.

Figure 8:
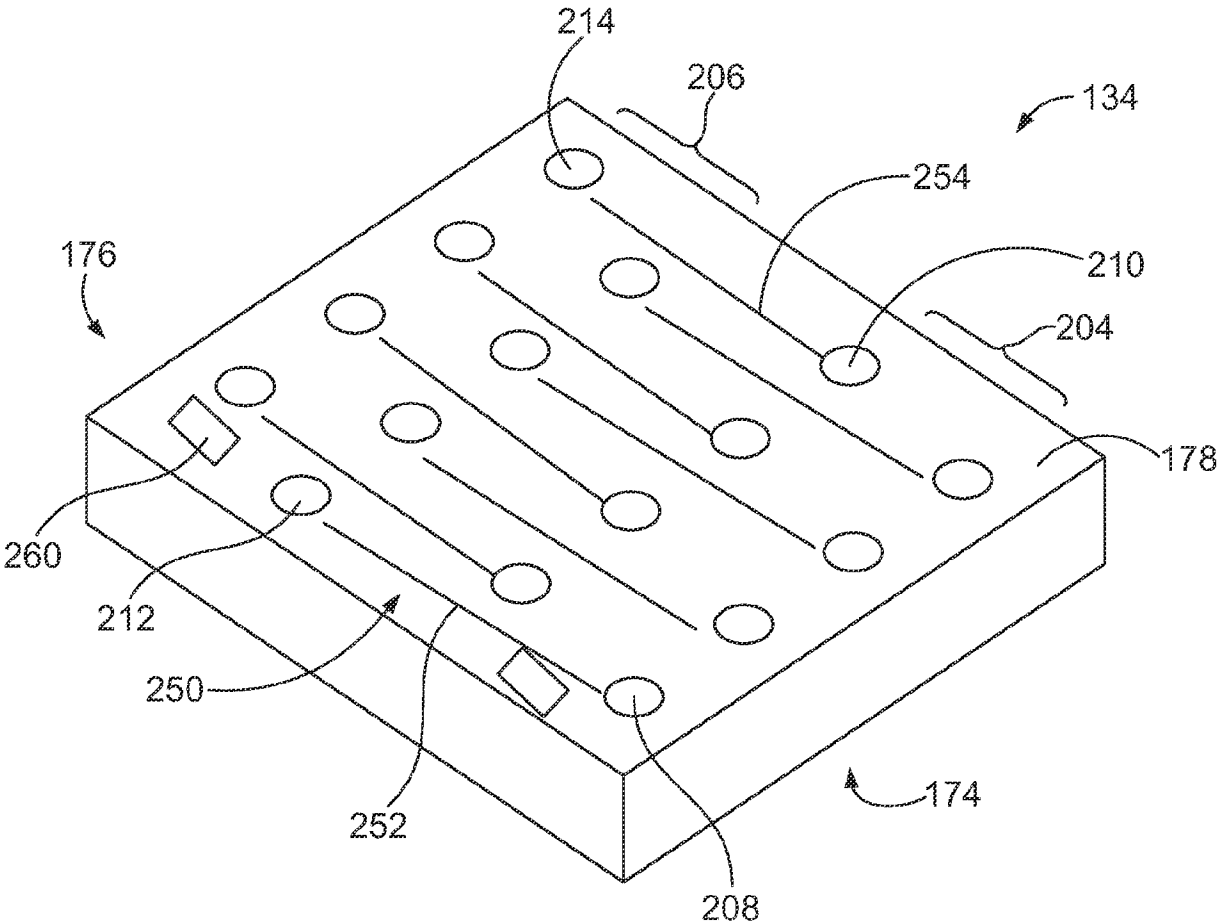
FIG. 8 is a top perspective view of a substrate formed in accordance with an embodiment.

FIG. 8 illustrates the substrate 134. The terminal apertures 204 and the contact apertures 206 are arranged in rows along the substrate 134. The substrate 134 includes signal traces 250 extending therethrough. The signal traces 250 extend between the wire end 174 of the substrate 134 and the mating end 176 of the substrate 134. The signal traces 250 are configured to convey electrical signals through the substrate 134. The electrical signals may include data and/or power signals.

The signal traces 250 include front signal traces 252 and rear signal traces 254. The front signal traces 252 extend between the front terminal apertures 208 and the front contact apertures 212. The front signal traces 252 convey electrical signals between the front wire terminals 160 and the front mating contacts 190. The rear signal traces 254 extend between the rear terminal apertures 210 and the rear contact apertures 214. The rear signal traces 254 convey electrical signals between the rear wire terminals 162 and the rear mating contacts 192. The terms "front" and "rear" as used with respect to the signal traces 250 designate the wire terminal 152 and the mating contact 128 to which the signal trace 250 is joined. The terms "front" and "rear" as used with respect to the signal traces 250 are not used to designate a position of the signal traces 250. The signal traces 250 may extend along the mounting surface 178 of the substrate 134 and/or be embedded within the substrate 134.

The substrate 134 includes circuitry 260. The circuitry 260 may extend along the mounting surface 178 of the substrate 134 and/or be embedded within the substrate 134. In one embodiment, the circuitry 260 includes at least one module that is coupled to the mounting surface 178 of the substrate 134. The module may include a power module, a data module, or the like. The circuitry 260 tunes the connector 100 to achieve a predetermined performance of the connector 100. For example, the circuitry 260 may provide a predetermined speed of the connector 100 that is required for applications of the connector. The circuitry 260 may control crosstalk between differential pairs joined to the wire terminals 152. The circuitry 260 may reduce the crosstalk between the differential pairs to a predetermined level.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the invention without departing from their scope. While the dimensions and types of materials described herein are intended to define the parameters of the various embodiments of the invention, the embodiments are by no means limiting and are exemplary embodiments. Many other embodiments will be apparent to those of skill in the art upon reviewing the above description. The scope of the various embodiments of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose the various embodiments of the invention, including the best mode, and also to enable any person skilled in the art to practice the various embodiments of the invention, including making and using any devices or systems and performing any incorporated methods. The patentable scope of the various embodiments of the invention is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

What is claimed is:

1. An electrical connector comprising:

a substrate having a wire end and a mating end, the substrate having signal traces extending between the wire end and the mating end, the substrate having a mounting surface being arranged horizontally;

wire terminals joined to the wire end of the substrate, each of the wire terminals electrically coupled to a signal trace, each of the wire terminals being generally planar and extending from the mounting surface of the substrate to a top of the wire terminal, each of the wire terminals having a slot open at the top configured to receive a conductor of a cable therein through the slot, the wire terminals arranged in a front group and a rear group, the front group of wire terminals positioned proximate to the wire end of the substrate, the rear group of wire terminals positioned distally from the wire end of the substrate, the front group of wire terminals having a height measured between the mounting surface of the substrate and the tops of the wire terminals of the front group, the rear group of wire terminals having a height measured between the mounting surface of the substrate and the tops of the wire terminals of the rear group, the height of the front group of wire terminals being different than the height of the rear group of wire terminals; and mating contacts joined to the mating end of the substrate, each of the mating contacts electrically coupled to a signal trace such that the signal trace directs electrical signals between a wire terminal and the mating contact, the mating contacts configured to engage a contact of a corresponding connector.

2. The electrical connector of claim 1, wherein the wire terminals receive the corresponding conductors in a downward receiving direction along the height through the tops.

3. The electrical connector of claim 1, wherein the wire terminals are configured as blades, the blades of the front group extending in a front plane, the blades of the rear group extending in a rear plane that is non-parallel to the front plane.

4. The electrical connector of claim 1, wherein the tops of the wire terminals of the rear group are stepped up from the tops of the wire terminals of the front group.

5. The electrical connector of claim 1, wherein the wire terminals are configured as blades that extend in a direction that is non-orthogonal to a loading direction of the cable.

6. The electrical connector of claim 1, wherein the mating contacts include a connector to join the mating contacts to the substrate.

7. The electrical connector of claim 1 further comprising a retention housing having slots to retain the wire terminals.

8. An electrical connector comprising:

a housing having a wire end and a mating end;

a substrate positioned within the housing, the substrate having a wire end proximate to the wire end of the housing and a mating end proximate to the mating end of the housing, the substrate having signal traces extending between the wire end and the mating end, the substrate having a mounting surface being arranged horizontally;

wire terminals joined to the wire end of the substrate, each of the wire terminals electrically coupled to a signal trace, each of the wire terminals being generally planar and extending from the mounting surface of the substrate to a top of the wire terminal, each of the wire terminals having a slot open at the top configured to receive a conductor of a cable therein through the slot, the wire terminals arranged in a front group and a rear group, the front group of wire terminals positioned proximate to the wire end of the substrate, the rear group of wire terminals positioned distally from the wire end of the substrate, the front group of wire terminals having a height measured between the mounting surface of the substrate and the tops of the wire terminals of the front group, the rear group of wire terminals having a height measured between the mounting surface of the substrate and the tops of the wire terminals of the rear group, the height of the front group of wire terminals being different than the height of the rear group of wire terminals; and mating contacts joined to the mating end of the substrate, each of the mating contacts electrically coupled to a signal trace such that the signal trace directs electrical signals between a wire terminal and the mating contact, the mating contacts configured to engage a contact of a corresponding connector.

9. The electrical connector of claim 8, wherein the wire terminals receive the corresponding conductors in a downward receiving direction along the height through the tops.

10. The electrical connector of claim 8, wherein the wire terminals are configured as blades, the blades of the front group extending in a front plane, the blades of the rear group extending in a rear plane that is non-parallel to the front plane.

11. The electrical connector of claim 8, wherein the tops of the wire terminals of the rear group are stepped up from the tops of the wire terminals of the front group.

12. The electrical connector of claim 8, wherein the wire terminals are configured as blades that extend in a direction that is non-orthogonal to a loading direction of the cable.

13. The electrical connector of claim 8, wherein the mating contacts include a connector to join the mating contacts to the substrate.

14. The electrical connector of claim 8, wherein the mating connectors include a connector end, the connector end of a first mating contact positioned closer to the mating end of the substrate than the connector end of a second mating contact, the first mating contact positioned adjacent to the second mating contact.

15. The electrical connector of claim 8 further comprising a retention housing coupled to the housing to retain the wire terminals.

16. The electrical connector of claim 8 further comprising a retention housing coupled to the housing to insulate the wire terminals.

17. An electrical connector comprising:

a substrate having a wire end and a mating end, the substrate having signal traces extending between the wire end and the mating end, the substrate having a mounting surface being arranged horizontally;

a front group of wire terminals joined to the substrate proximate to the wire end of the substrate, the wire terminals of the front group configured as blades that extend in a vertical plane that is non-orthogonal to the wire end of the substrate, the front group of wire terminals being configured to be coupled to corresponding conductors of a cable;

a rear group of wire terminals joined to the substrate distally from the wire end of the substrate, the wire terminals of the rear group configured as blades that extend in a vertical plane that is non-parallel to the plane of the front group of wire terminals, the rear group of wire terminals being configured to be coupled to corresponding conductors of the cable;

mating contacts joined to the mating end of the substrate, the mating contacts including front mating contacts and rear mating contacts, the front group of wire terminals electrically coupled to the front mating contacts and the rear group of wire terminals electrically coupled to the rear mating contacts.

18. The electrical connector of claim 17, wherein each of the wires terminals extends from the mounting surface of the substrate to a top of the wire terminal, the rear group of wire terminals has a height measured between the mounting surface of the substrate and the tops of the wire terminals of the rear group, the front group of wire terminals having a height measured between the mounting surface of the substrate and the tops of the wire terminals of the front group, the height of the rear group of wire terminals being different than the height of the front group of wire terminals.

19. The electrical connector of claim 17, wherein the wire terminals of the rear group include a top that is stepped up from a top of the wire terminals of the front group.

20. The electrical connector of claim 17, wherein the mating connectors include a connector end, the connector end of a first mating contact positioned closer to the mating end of the substrate than the connector end of a second mating contact, the first mating contact positioned adjacent to the second mating contact.

* * * * *